US005537900A

United States Patent [19]

Schaar

[11] Patent Number: 5,537,900

[45] Date of Patent: Jul. 23, 1996

[54] TOGGLED BREAKOUT WRENCH

[75] Inventor: Bernard Schaar, Sherman, Tex.

[73] Assignee: Reedrill Corporation, Sherman, Tex.

[21] Appl. No.: 392,051

[22] Filed: Feb. 22, 1995

[51] Int. Cl.[6] ..... B25B 13/50

[52] U.S. Cl. ..... 81/57.33; 81/57.19; 81/572

[58] Field of Search ..... 81/57.33, 57.34, 81/57.15, 57.16, 57.18, 57.19, 57.2, 57.39, 57.44, 57.35, 59.1

[56] References Cited

U.S. PATENT DOCUMENTS

| | | | |
|---|---|---|---|
| 2,737,839 | 3/1956 | Paget | 81/57.34 X |
| 3,316,783 | 5/1967 | Wilson | 81/57.34 |
| 3,398,612 | 8/1968 | Batten | 81/59.1 X |
| 3,662,867 | 5/1972 | Kinzbach | 81/59.1 X |
| 3,892,148 | 7/1975 | Wiley | 81/57.2 X |
| 4,023,449 | 5/1977 | Boyadjieff | 81/57.34 X |
| 4,194,419 | 3/1980 | Mitchhart et al. . | |
| 4,696,207 | 9/1987 | Boyadjieff | 81/57.34 |

*Primary Examiner*—D. S. Meislin
*Attorney, Agent, or Firm*—David H. Judson; Brian Walker

[57] ABSTRACT

A Toggled Breakout Wrench is described for use with a drilling rig having a drill stem made up of one or more drill pipe sections. The wrench comprises an arm movably connected to the drilling rig such that the arm will move in a substantially arctuate path about a drill pipe section. Pivotally mounted to the arm are a pair of opposed jaws for clamping about the drill pipe section to assist in breaking loose the threaded connections of the drill pipe sections. A toggle linkage enables the opposed jaws to move between a clamping and a non-clamping position about the drill pipe section.

11 Claims, 2 Drawing Sheets

FIG. 1
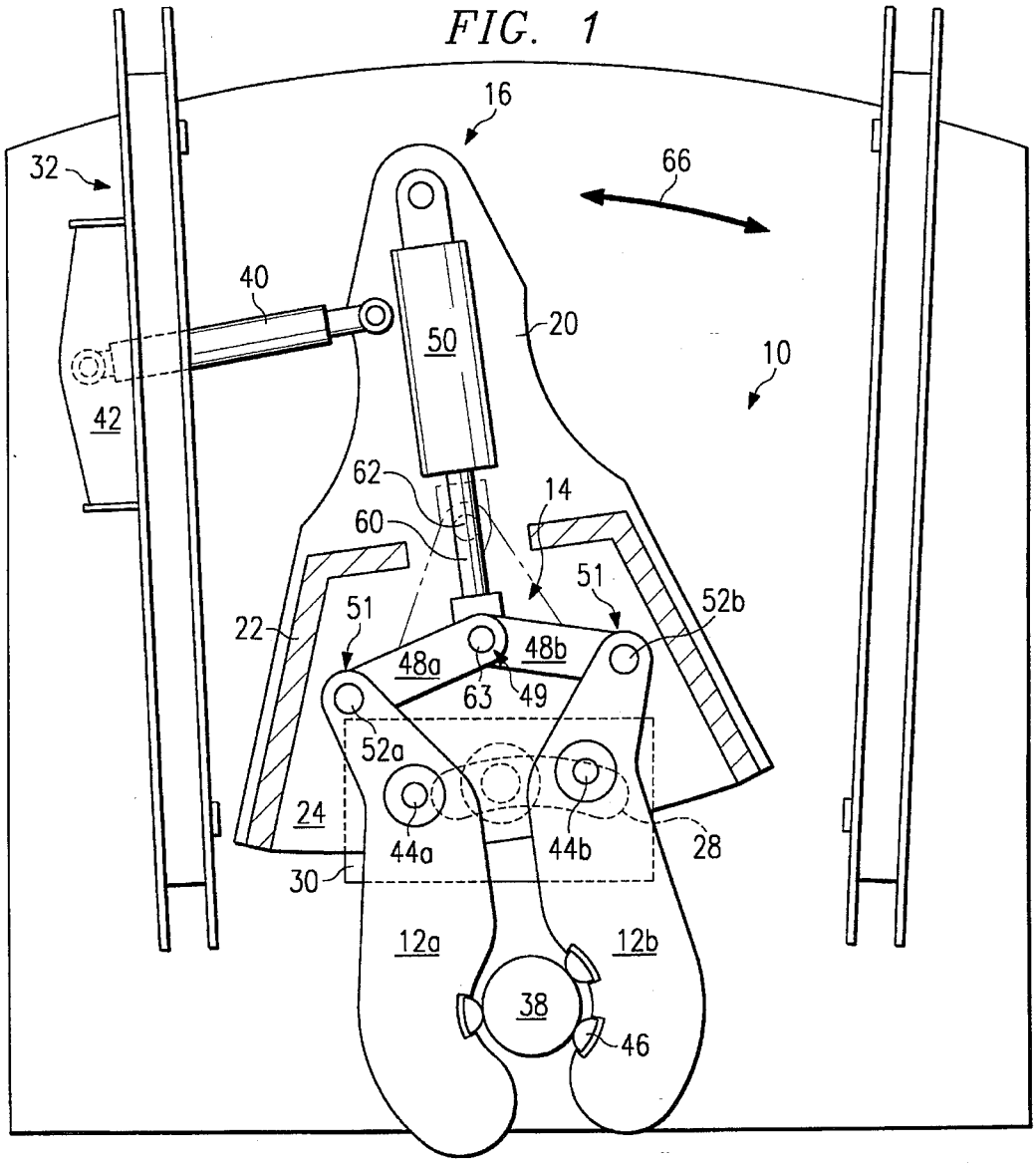
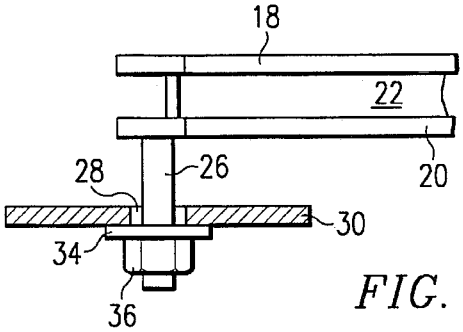
FIG. 2

TOGGLED BREAKOUT WRENCH

TECHNICAL FIELD

The present invention relates to drill pipe handling mechanisms, and more particularly to a toggled breakout wrench for loosening threaded connections between drill pipe sections of a drill stem.

BACKGROUND OF THE INVENTION

In the art of earth drilling apparatus, the procedure for handling and storing sectional drill pipe members has long been one in which improvements have been sought. The problem of unscrewing the threaded joints connecting drill pipes sections has resulted in numerous devices for clamping and holding one pipe section while rotating another pipe section to unscrew the threaded connection between the sections. U.S. Pat. No. 3,680,412 discloses an example of a power operated holding and wrenching device for breaking loose joints of threaded sectional drill pipe.

Other types of breakout wrenches require a swing boom to position the wrench about the drill stem to break loose a drill pipe section. The breakout wrenches of this type are not positioned directly adjacent the drill stem. This requires that the breakout wrench be rotated into place and, depending upon a particular design, may require this procedure be done manually, exposing an individual to the adverse environmental conditions surrounding the drill hole. The breakout wrenches which are swung into place via a boom also require a much larger operating area, area which may not be available on a drilling rig where space is at a premium.

SUMMARY OF THE INVENTION

The present invention overcomes the foregoing and other problems with a toggled breakout wrench. The breakout wrench of the present invention comprises a pair of opposed jaws positioned about the drill stem such that the jaws may engage a drill pipe section of the drill stem. A toggle linkage enables the opposed jaws to be moved between a clamping position and a non-clamping position on the drill pipe section. The pair of opposed jaws are pivotally connected to a rotation arm, and the arm is connected to a drill rig in a manner such that the arm and opposed jaws rotate in an arctuate path about the drill pipe section to facilitate breaking loose threaded connections between adjacent drill pipe sections.

In normal operation, the toggle linkage would be in the non-clamping position such that the pair of opposed jaws are open allowing the drill pipe stem to move freely between the jaws. When the threaded connection between adjacent drill pipe sections is stuck due to an overly tight fit, the toggle linkage is actuated with a hydraulic actuator to move the linkage and the pair of opposed jaws to the clamping position. A second hydraulic actuator rotates the rotation arm and opposed jaws in an arctuate path about the drill pipe section to break loose the threaded connection with the adjacent drill pipe section.

The foregoing has outlined some of the more pertinent aspects of the present invention. These aspects should be construed to be merely illustrative of some of the more prominent features and applications of the invention. Many other beneficial results can be obtained by applying the disclosed invention in a different manner or modifying the invention as will be described. Accordingly, other aspects and a fuller understanding of the invention may be had by referring to the following detailed description of the preferred embodiment.

BRIEF DESCRIPTION OF THE DRAWINGS

Other objects and advantages of the present invention will become more apparent from the following detailed description of preferred embodiments when read in conjunction with the accompanying figures wherein:

FIG. 1 is a top view of a toggled breakout wrench having the upper plate of the rotation arm removed;

FIG. 2 is a side view of the rotation arm mounting pin; and

DETAILED DESCRIPTION

Figure 3:
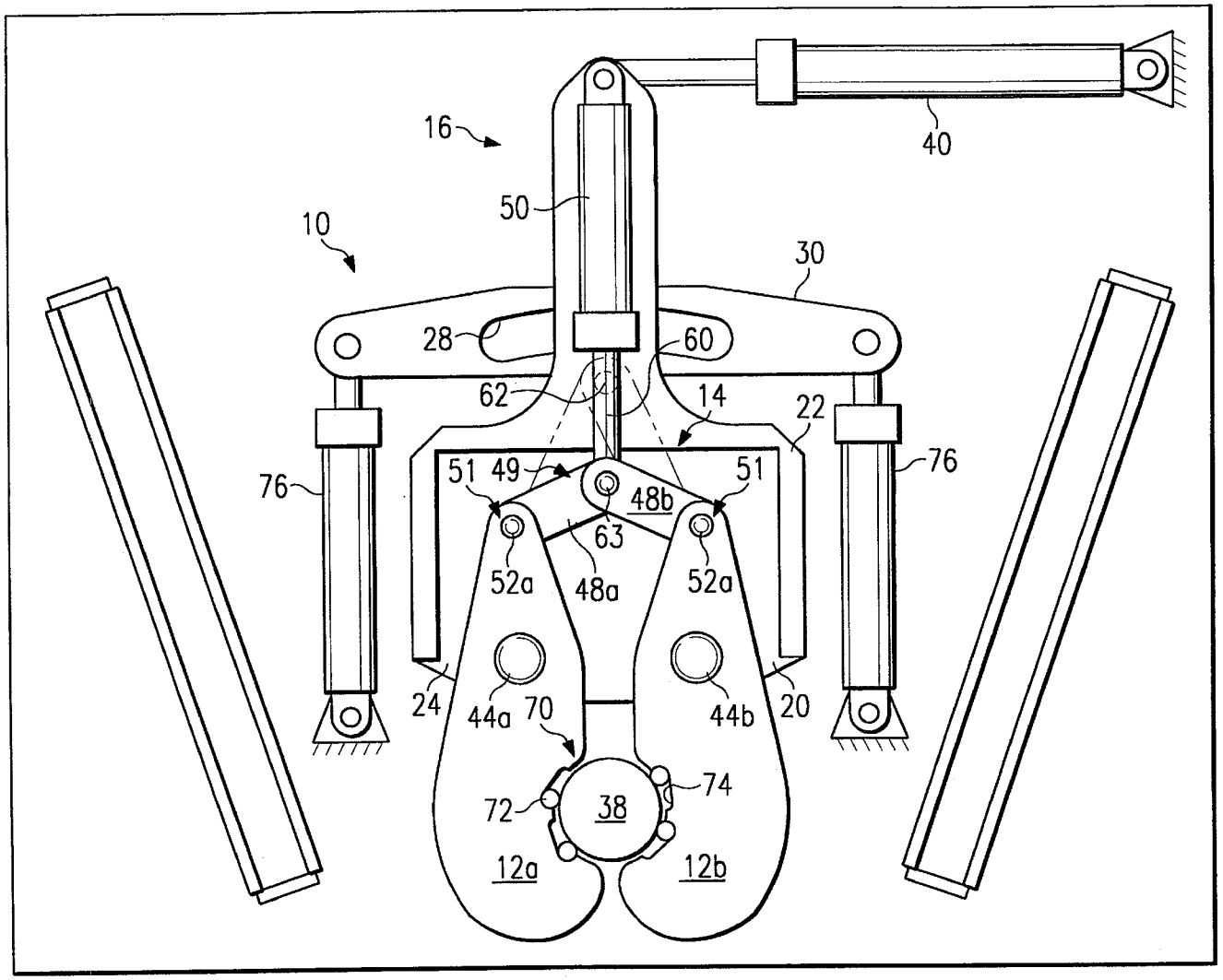
FIG. 3 is a top view of an alternative embodiment of a toggled breakout wrench.

Referring now to the drawings, and more particularly to FIG. 1 there is illustrated a top view of a toggled breakout wrench 10 according to the present invention. The toggled breakout wrench 10 comprises a clamping mechanism 12, toggle linkage 14 and rotation arm 16. For purposes of illustration, the upper plate 18 of the rotation arm 16 has been removed to provide a better view of the operating mechanisms of the Invention 10.

The rotation arm 16 comprises an upper plate 18 and lower plate 20. A retaining wall 22 separates the opposed upper and lower plates 18, 22 and provides a chamber 24 for the toggle linkage 14. Referring now also to FIG. 2 threaded mounting pin 26 extends from the bottom plate 20 to engage an arctuate slot 28 of plate 30 mounted to the structure of drilling rig 32. The mounting pin 26 is maintained within arctuate slot 28 of plate 30 by a washer 34 and nut 36 assembly. The mounting pin 26 and slot 28 enable the rotation arm 16 to move in an arctuate path with respect to the drill pipe section 38. This operation will be more fully discussed in a moment. It should be noted that the pin and slot assembly described above is only one potential embodiment of the present invention and that any connection means enabling the rotating arm to move in an arctuate path about the drill stem would be acceptable. The rotation arm 16 is further connected to the drill rig 32 via a hydraulic actuator 40 connected to a bracket 42.

The clamping mechanism 12 comprises an opposed pair of jaws **12*a* and 12*b*. These jaws are pivotally connected to the rotation arm 16 by pins 44*a* and 44*b*. The jaws 12*a* and 12*b* are provided with removable serrated inserts 46 for assisting in a tight engagement with a drill pipe section 38. The jaws 12*a* and 12*b* connect with the toggle linkage 14 within the chamber 24. The toggle linkage 14 comprises a pair of toggle arms 48*a* and 48*b*. The first ends 49 of the toggle arms 48*a* and 48*b* are connected to each other at actuator arm 60 of hydraulic actuator 50. The opposite end of hydraulic actuator 50 is connected to rotation arm 16. The second ends 51 of the toggle arms 48*a* and 48*b* are connected to the opposed jaws 12*a* and 12*b* at pins 52*a* and 52*b*** respectively.

During normal drilling operations, the actuator arm 60 of hydraulic actuator 50 is withdrawn to a position represented generally at point 62. This causes the opposed jaws **12*a* and 12*b* to move to an unclamped position about the drill pipe section 38. The drill stem may then move freely between the jaws 12. When a drill pipe section 38 must be broken loose from an adjacent section, the hydraulic actuator 50 is actuated to move the actuator arm 60 to the position shown generally at point 63. The opposed jaws 12*a* and 12*b* move to a clamping position about drill pipe section 38 as shown in FIG. 1. Once the drill pipe section 38 is firmly clamped between jaws 12***a* and 12*b*, hydraulic actuator 40 is activated to rotate the rotation arm 16 in the direction illustrated generally by arrow 66. This causes the mounting pin 26 of rotation arm 16 to slide along slot 28 such that the rotation arm 16 and opposed jaws 12 rotate in a generally arctuate path 66 about the drill pipe section 38. This causes the drill pipe section 38 to rotate in the same direction, thus assisting in breaking loose the threaded connection between the drill pipe section 38 and an adjacent drill pipe section.

Referring now to FIG. 3, there is illustrated an alternative embodiment of the present invention. Similar reference numerals have been utilized on similarly related parts. As discussed previously, the breakout wrench mechanism 10 comprises a clamping mechanism 12, toggle linkage 14, and rotation arm 16. In this embodiment, the opposed jaws 12 utilize a ramped roller mechanism 70 consisting of roller 72 and a cut ramp portion 74 in the surface of a jaw. When the opposed jaws 12 are in a clamped position and the jaws rotate about a drill pipe section 38, the rollers 72 rotate up the ramp 74 generating a tighter grip between the jaws and the drill pipe section.

The arctuate slot 28 of this embodiment is connected between a pair of hydraulic actuators 76. Actuation of the toggle linkage 14 and rotation arm 16 are in a manner similar to that discussed previously with respect to FIG. 1. The present embodiment further enables the breakout wrench 10 to be withdrawn from its location about the drill pipe section 36 by actuating the hydraulic actuators 76 to an extended position such that the breakout wrench 10 is moved away from the drill pipe section 38 in the direction indicated by arrow 78.

It should be appreciated by those skilled in the art that the specific embodiments disclosed above may be readily utilized as a basis for modifying or designing other structures for carrying out the purposes of the present invention. It should also be realized by those skilled in the art that such equivalent construction do not depart from the spirit and scope of the invention as set forth in the appended claims.

I claim:

1. A breakout wrench for use with a drilling rig including a drill stem made up of one or more drill pipe sections, comprising:

a rotation arm having a pin extending from the bottom side thereof, the pin slidably connecting the rotation arm to the drilling rig such that the rotation arm moves in a substantially arcuate path about a drill pipe section;

a pair of opposed jaws pivotally connected to the rotation arm for clamping on the drill pipe section;

a first toggle linkage arm having a first end connected to one of the pair of opposed jaws;

a second toggle linkage arm having a first end connected to the other one of the pair of opposed jaws and a second end connected to a second end of the first toggle linkage arm; and a first actuator connected to the second ends of the first and second toggle linkage arms for actuating the pair of opposed jaws between a clamping position and a non-clamping position around the drill pipe section to enable gripping of the drill pipe section by the opposed jaws while breaking a threaded connection with the drill pipe section; and a second actuator arm for rotating the rotation arm along the arcuate path about the drill pipe section, wherein the pin extending from the rotation arm guides and stabilizes the rotation arm while breaking loose the threaded connection with the drill pipe section.

2. The breakout wrench of claim 1 wherein the pair of opposed jaws include serated inserts for gripping the drill pipe section.

3. The breakout wrench of claim 1 wherein the pair of opposed jaws include ramped rollers for gripping the drill pipe section.

4. The breakout wrench of claim 1, further including means for moving the pair of opposed jaws and arm between a first position about the drill pipe section and a second position away from the drill pipe section.

5. A breakout wrench for use with a drilling rig including a drill stem made up of one or more drill pipe sections, comprising:

a rotation arm having a pin extending from the bottom side thereof, the pin slidably connecting the rotation arm to the drilling rig such that the rotation arm moves in a substantially arcuate path about a drill pipe section;

a pair of opposed jaws pivotally connected to the rotation arm for engaging the drill pipe section;

a toggle linkage connected to the opposed jaws for moving the opposed jaws between a clamping position and a non-clamping position on the drill pipe section;

a first hydraulic actuator for actuating the toggle linkage between the clamping position and the non-clamping position around the drill pipe section to enable gripping of the drill pipe section by the pair of opposed jaws while breaking a threaded connection with the drill pipe section; and a second hydraulic actuator for rotating the rotation arm along the arcuate path about the drill pipe section, wherein the pin extending form the rotation arm guides and stabilizes the rotation arm while breaking loose the threaded connection with the drill pipe section.

6. The breakout wrench of claim 5 wherein the pair of opposed jaws include serated inserts for gripping the drill pipe section.

7. The breakout wrench of claim 5 wherein the pair of opposed jaws include ramped rollers for gripping the drill pipe section.

8. The breakout wrench of claim 5, further including means for moving the pair of opposed jaws and arm between a first position about the drill pipe section and a second position away from the drill pipe section.

9. The breakout wrench of claim 5, wherein the toggle linkage includes first and second toggle linkage arms having first ends connected to each other and to the second hydraulic actuator and having second ends connected to each of the pair of opposed jaws.

10. A breakout wrench for use with a drilling rig including a drill stem made up of one or more drill pipe sections, comprising:

a rotation arm slidably connected to the drilling rig such that the rotation arm slides in a substantially arctuate path about a drill pipe section;

a pair of opposed jaws pivotally connected to the rotation arm for clamping on the drill pipe section;

a first toggle linkage arm having a first end connected to one of the pair of opposed jaws;

a second toggle linkage arm having a first end connected to the other end of the pair of opposed jaws and a second end connected to a second end of the first toggle linkage arm;

a first actuator connected to the second ends of the first and second toggle linkage arms for actuating the pair of opposed jaws between a clamping position and a non-clamping position around the drill pipe section to enable gripping of the drill pipe section by the opposed jaws during breaking of a threaded connection with the drill pipe section; and a second actuator arm for rotating the rotation arm along the substantially arcuate path about the drill pipe section for breaking the threaded connection with the drill pipe section.

11. The breakout wrench of claim 10 further including means for moving the pair of opposed jaws and arm between a first position about the drill pipe section and a second position away from the drill pipe section.

* * * * *